343-700 MS AU 256 EX
2/27/79 OR 4,142,190

United States Patent [19]
Kerr

[11] 4,142,190
[45] Feb. 27, 1979

[54] MICROSTRIP FEED WITH REDUCED APERTURE BLOCKAGE

[75] Inventor: John L. Kerr, Neptune, N.J.

[73] Assignee: The United States of America as represented by the Secretary of the Army, Washington, D.C.

[21] Appl. No.: 838,044

[22] Filed: Sep. 29, 1977

[51] Int. Cl.[2] ..... H01Q 1/38; H01Q 19/12
[52] U.S. Cl. ..... 343/700 MS; 343/840
[58] Field of Search ..... 343/700 MS, 824, 830, 343/840, 846

[56] References Cited

U.S. PATENT DOCUMENTS 3,771,161 11/1973 Phillips ..... 343/840
3,778,717 12/1973 Okoshi et al. ..... 343/700 MS

*Primary Examiner*—Eli Lieberman
*Attorney, Agent, or Firm*—Nathan Edelberg; Jeremiah G. Murray; Bernard Franz

[57] ABSTRACT

A parabolic reflector is fed by a microstrip antenna supported at the focus by a tube aligned along the focal axis of the reflector.

The invention described herein may be manufactured and used by or for the Government for governmental purposes without the payment of any royalties thereon or therefor.

8 Claims, 9 Drawing Figures

MICROSTRIP FEED WITH REDUCED APERTURE BLOCKAGE

FIELD OF THE INVENTION

This invention relates to microstrip antennas, and, more particularly, to the use of the antenna design described in U.S. patent application Ser. No. 729,513, now U.S. Pat. No. 4,060,810 in conjunction with a parabolic reflector in a manner to eliminate the need for a tripod support for the microstrip radiator.

BACKGROUND OF THE INVENTION

As is well known and understood, a typical feed for a parabolic reflector has an aperture on the order of one wavelength or more to provide the required illumination for low sidelobe performance. A reflector of ten wavelengths or more in diameter is then often employed to minimize aperture blockage. However, the tripod support arrangement for the typical feed has been found to unavoidably lead to undesirable aperture blockage.

SUMMARY OF THE INVENTION

As is described in U.S. Pat. No. 4,060,810 (filed Oct. 4, 1976, issued Nov. 29, 1977 and assigned to the same assignee as is this instant invention), a microstrip antenna is a printed circuit device in which the radiating element is typically a rectangular patch of metal etched on one side of a dual-clad circuit board, with the size of the element being dependent upon the resonant frequency desired and upon the dielectric constant of the circuit board material. The microstrip antenna design there described followed from a finding that the resonant frequency of a given size radiator decreased if a central portion of the etched metal element were removed. As will be seen below, this invention makes use of the additional described finding — that, with the central portion of the dual-clad circuit board also removed, the size of the radiator could be reduced and yet still operate at the same resonant frequency — in providing a microstrip feed with reduced aperture blockage. According to the present invention, the microstrip antenna which serves as the feed for the parabolic reflector is supported at the focus by a rigid tube which is aligned along the focal axis of the reflector and which attaches to the rear of the microstrip feed through the hole thus formed in the radiator circuit board. In addition to simplifying the overall support construction, this configuration has also been found to provide a significant improvement in sidelobe performance as compared with the conventional tripod support arrangement.

BRIEF DESCRIPTION OF THE DRAWINGS

These and other features of the present invention will be more clearly understood from a consideration of the following description, taken in connection with the accompanying drawings in which.

DETAILED DESCRIPTION OF THE DRAWINGS

Figure 1:
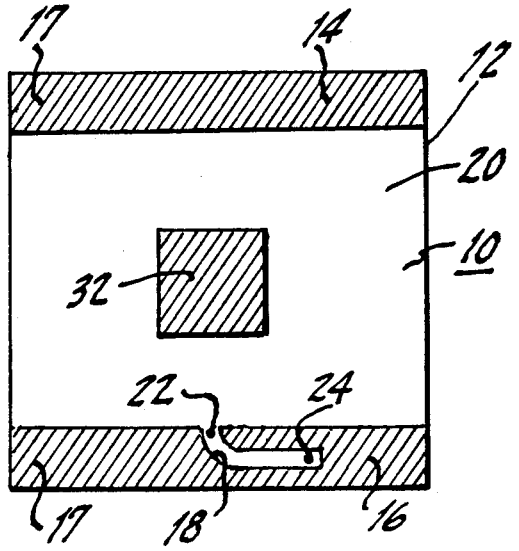
Fig.1. PRIOR ART
FIG. 1 shows a microstrip antenna constructed in accordance with the teachings of the 4,060,810 patent.

In FIG. 1, the microstrip antenna 10 is shown as comprising a circuit board 12, the back side of which (not shown) is clad entirely of a metal material, typically copper. In conventional constructions, the front side of the circuit board is clad of like material, except in the areas 14 and 16, where the metal is etched away to reveal the dielectric material 17 underneath. A setion of metal 18 extends from the rectangular metal patch 20 so formed, to operate as a microstrip transformer in matching the impedance at the input to the patch 22 to the impedance at the signal input jack 24, usually the output from a coaxial cable coupled through the back side of the circuit board 12.

In accordance with the invention described in application Ser. No. 729,513, the resonant frequency of the radiator was found to decrease if a central portion of the rectangular metal patch 20 were removed. For example, it was noted that if a 1-inch square area were removed at the center of the circuit board 12, then the resonant frequency would be lowered by slightly in excess of 9%, as compared with an unloaded microstrip antenna. It was further described how, if the central area, shown as 32 in the present FIG. 1, were so removed as to include the dielectric material beneath it and the copper cladding on the back side of the board 12 as well (thereby resulting in a 1-inch square hole completely through the circuit board 12), then the resonant frequency of the microstrip antenna would be lowered by approximately another 1%. If was further noted that the loaded microstrip antenna design as shown made possible a substantial reduction in the size of the rectangular metal patch 20 required for a given resonant frequency — for example, that the 9% decrease in resonant frequency which resulted from using a 1-inch square area of removed metal 32 could be offset by reducing the height between the areas 14, 16, by some 12%.

Testings have shown that a microstrip antenna of such design could be etched on a circuit board approximating one-half wavelength square, and provide useful results when feeding a parabolic reflector some five wavelengths in diameter. With a four-foot parabolic dish reflector having a "focal length to diameter" ratio of 0.375, this microstrip feed with a tripod support arrangement exhibited radiation patterns having −18 and −20 dB E− and H− plane sidelobes. The configuration of FIG. 2 shows just such a microstrip radiator - tripod support feed for a parabolic reflector.

Figure 2:
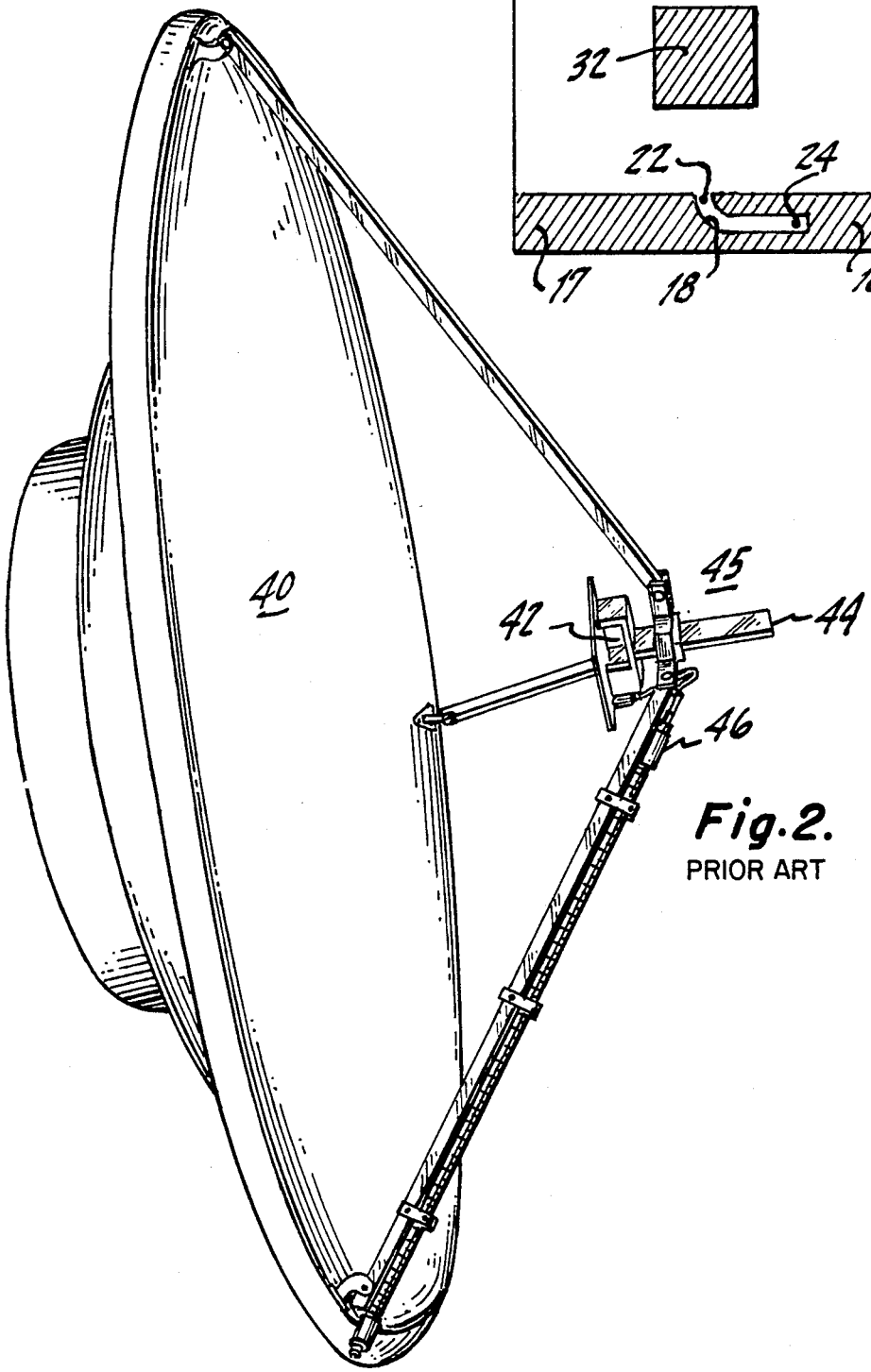
Fig.2. PRIOR ART
FIG. 2 illustrates a microstrip antenna feeding a parabolic reflector in which a tripod support is used.
Figure 3:
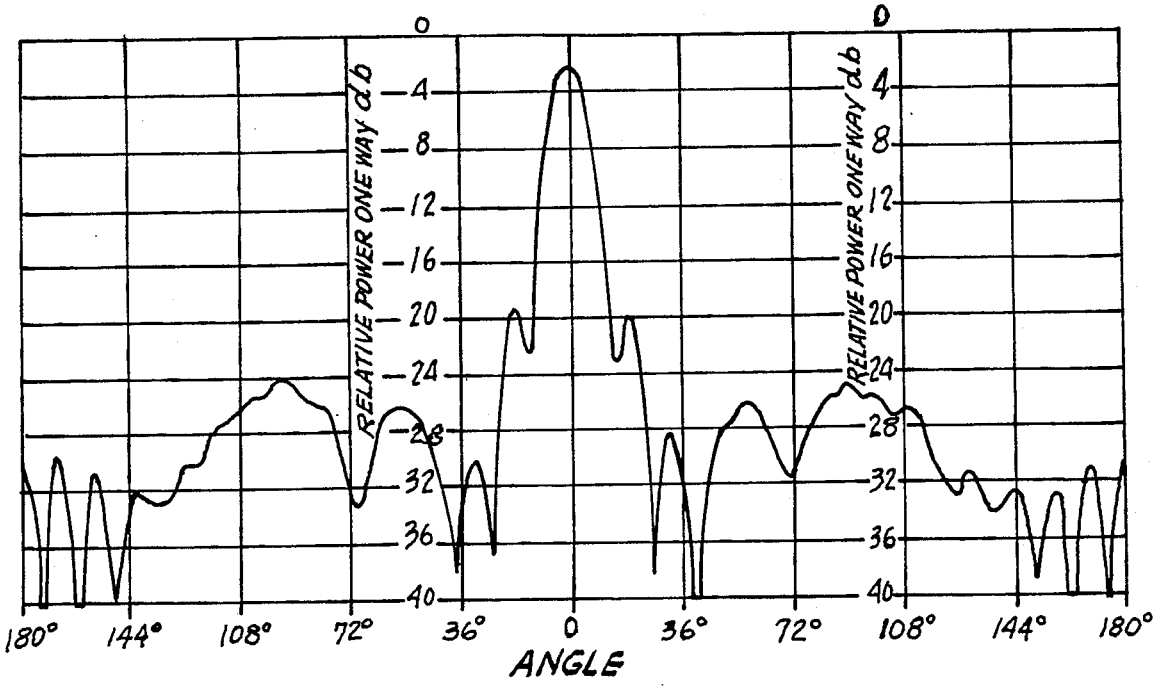
FIGS. 3 and 4 show radiation patterns obtained for the tripod support configuration of FIG. 2.
Figure 4:
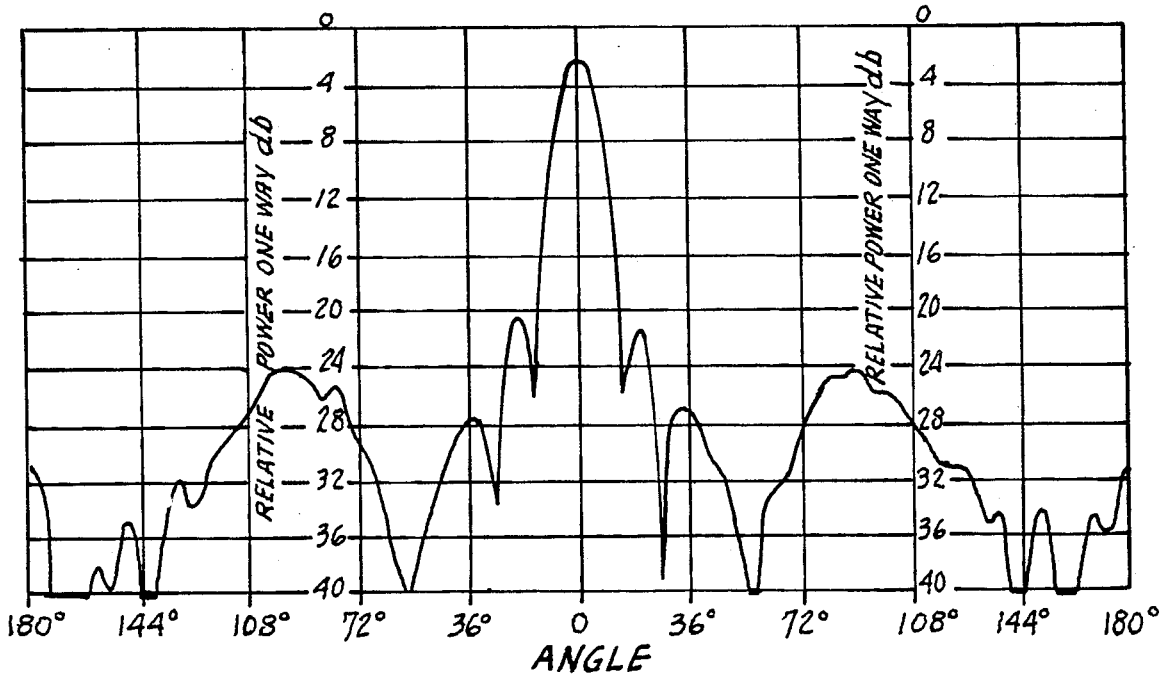

In FIG. 2, the parabolic dish is shown at 40, the microstrip antenna is shown at 42, and the tripod support, with an appropriate antenna holder 44, is shown at 45. A coaxial cable 46 runs along one of the aluminum arms of the tripod support 45, to couple the transmitter or receiver (not shown), to the back side of the microstrip antenna circuit board 12. FIG. 3 shows the radiation pattern for this configuration for the E− plane when the configuration is operated at a frequency of 1250 MHz, whereas FIG. 4 shows the radiation pattern for the H— plane at this same L-band frequency. As will be readily apparent to those skilled in the art, the sidelobe performance of −18 and −20 dB is quite good and compares favorably with alternative antenna designs. In this arrangement, the microstrip radiator will be understood to be the one where only the central portion of the rectangular metal patch 32 is removed.

Figure 5:
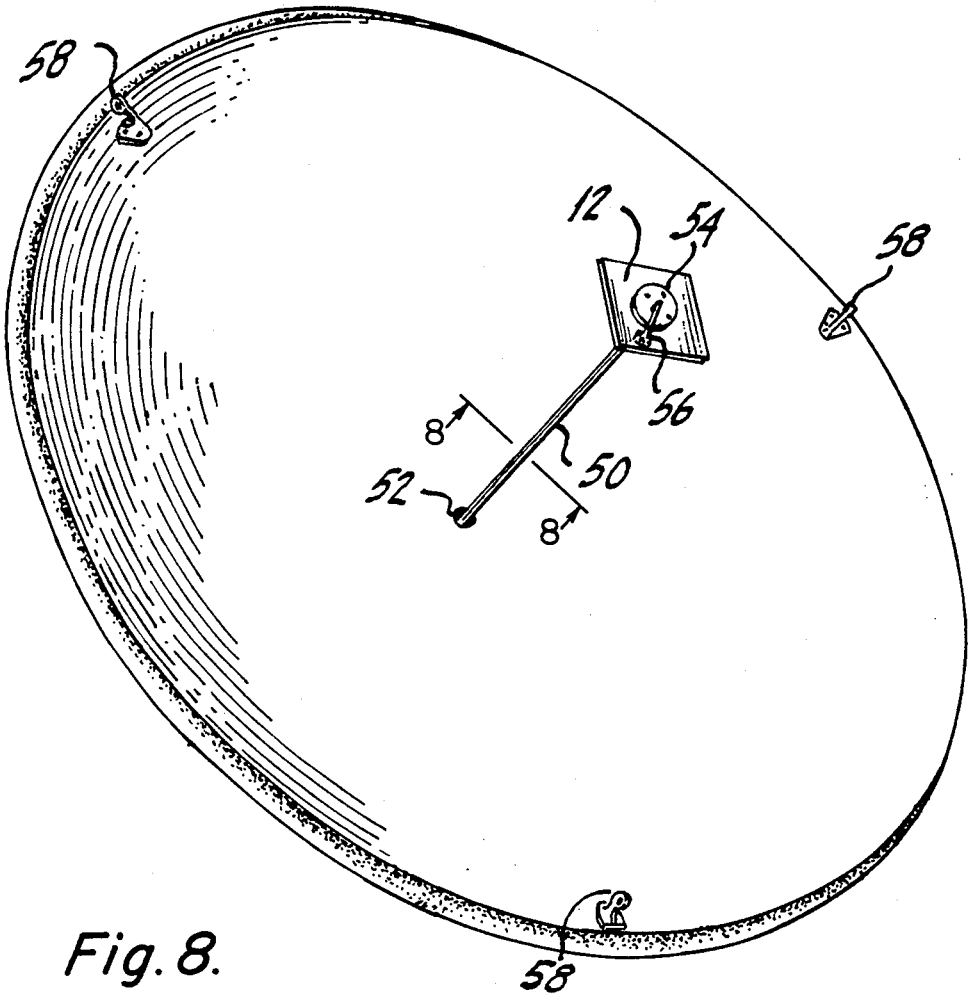
FIG. 5 shows a microstrip antenna feed for a parabolic reflector constructed in accordance with the present invention.
Figure 8:
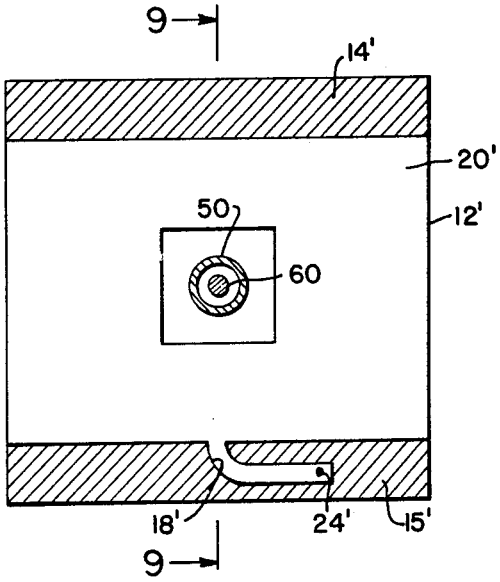
FIG. 8 shows the microstrip antenna as viewed along lines 8—8 of FIG. 5, also constructed in accordance with the teachings of the U.S. Pat. No. 4,060,810.
Figure 9:
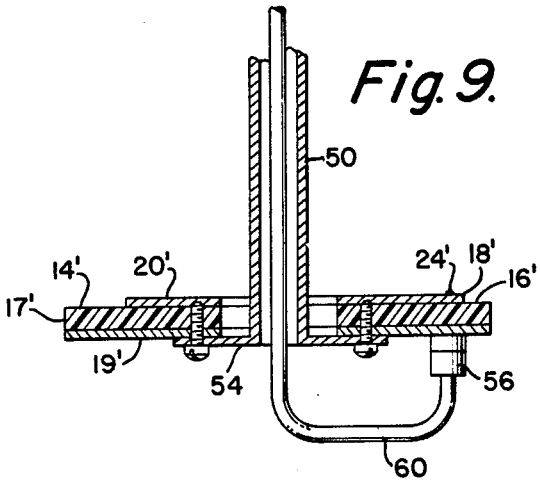
FIG. 9 is a cross section view along lines 9—9 of FIG. 8.

The construction of FIGS. 5, 8 and 9 on the other hand, becomes possible when the dielectric material in the central portion and the copper cladding on the back side of the circuit board 12′ are removed as well, as a first step in eliminating the conventional tripod support. In FIG. 5, a rigid tube 50 passes through a centrally located hole in the parabolic dish reflector 52, at one end, and through the centrally located hole in the microstrip antenna circuit board 12′, at the other end. A flanged disc 54 is secured to the back of the card 12′ with dielectric material screws, to serve in holding the tube 50 and microstrip antenna 10 together. The tube 50 can serve not only as the focal axis support for the microstrip antenna feed thusly, but can also serve as the outer conductor of the RF coaxial feed line from the transmitter or receiver (not shown). Alternatively, a smaller cable can be passed through the support tube 50, serving as the coaxial connector to be soldered to the card 12′ as the signal source — at 56, for example. (Additionally shown in FIG. 5 are the three clamps 58 previously used to secure the arms of the tripod support of FIG. 2.)

FIGS. 8 and 9 show the embodiment in which a coaxial cable 60 extends through the tube 50. While FIG. 1 shows a circuit board 12 with a square central area 32 removed from the metal patch 20, FIGS. 8 and 9 show a circuit board 12′ in which the central area removed extends through the metal patch 20′, the dielectric material 17′ and the copper cladding 19′ on the back side. The coaxial connector 56 includes a plug on the end of the coaxial cable 60, and a jack mounted on the back side of the circuit board 12′ with its central conductor extending through the board and soldered to the microstrip transformer 18′ at point 24′. The shell of the jack (outer conductor) is soldered to the ground plane 19′.

Figure 6:
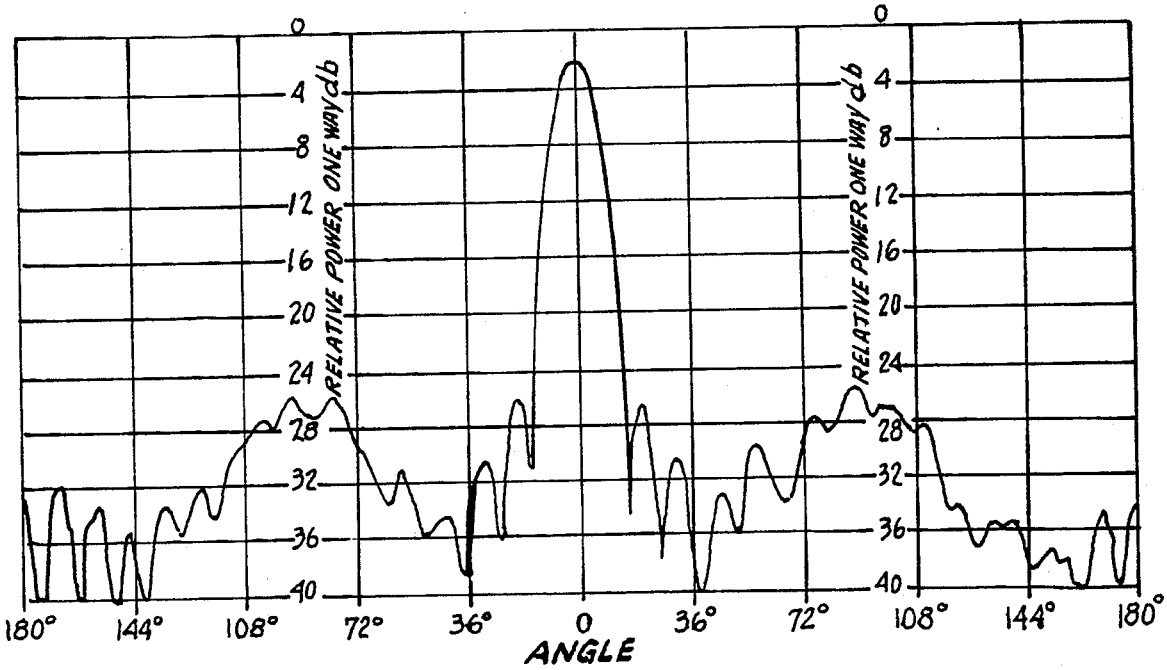
FIGS. 6 and 7 show radiation patterns obtained for the microstrip antenna feed configuration of FIG. 5.
Figure 7:
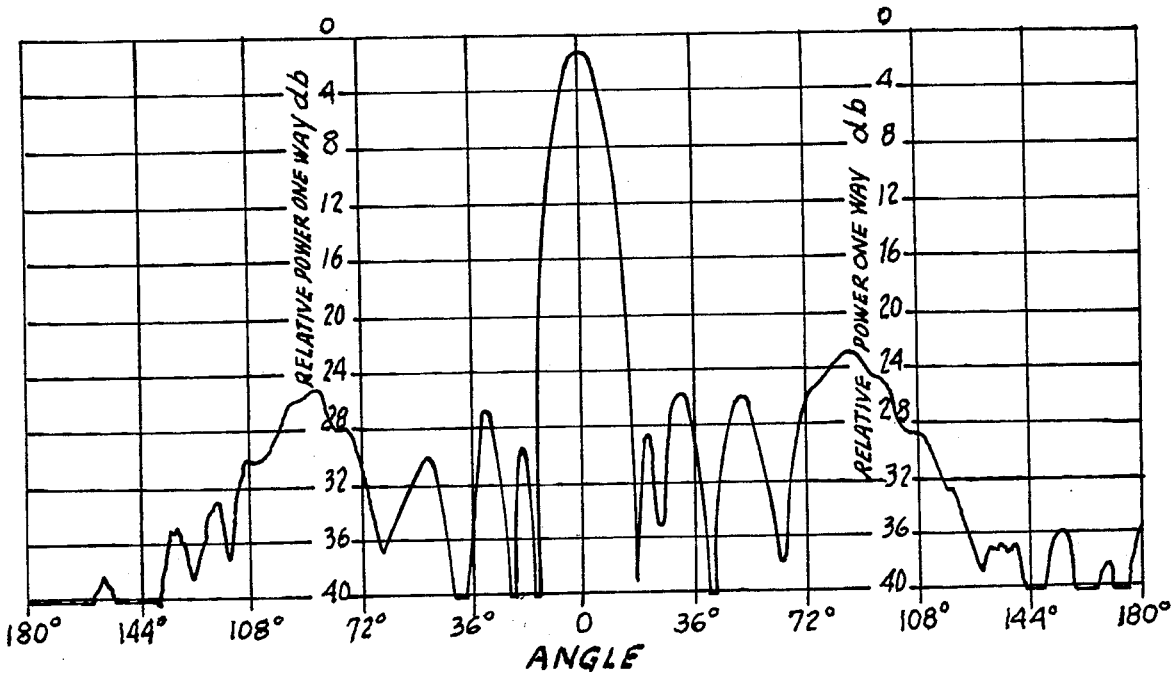

FIGS. 6 and 7 show the radiation patterns for the E— plane and H— plane, respectively, at the same 1250 MHz frequency and with the four foot parabolic dish reflector 40 as in FIG. 2, but using the microstrip antenna feed configuration of FIG. 5 instead. As will be readily apparent, the arrangement of FIG. 5 exhibits lower first sidelobes than were exhibited in FIGS. 3 and 4, −24 and −29 dB for the E— and H— planes, and represents a significant improvement in sidelobe performance.

These findings illustrate not only that the cost of using a microstrip antenna feed for a parabolic reflector could be reduced by eliminating the need for the tripod support, but that improved performance could be obtained as well. In fact, results indicate that parabolic dish reflectors of less than 5 wavelengths in diameter could be illuminated and yet still provide satisfactory sidelobe performance; additionally, operation at lower frequencies then previously envisioned could be considered. Improved performance could thus be obtained for the same size dish reflector, and comparable performance could be obtained using smaller size reflectors, even at lower frequencies.

While there has been described what is considered to be a preferred embodiment of the present invention, it will be readily apparent to those skilled in the art, that modifications may be made without departing from the scope of the teachings herein of using a length of tubing attached to the back of a microstrip antenna feed, passing through a centrally located hole in the radiator circuit board, to serve as the focal axis support for the feed itself. For example, although the present invention has been described with respect to the passing of a circular cross section tube through a square portion removed from the central area of the radiator patch, testing has shown that round or other configured portions could be removed from the patch as well, and still provide the general operation described herein. For at least this reason, therefore, reference should be had to the claims appended hereto in determining the scope of the invention.

I claim:

1. An antenna arrangement comprising:

a circuit board of dielectric material having a metallic ground plane on one side thereof;

a radiating element in the form of a patch of metal etched on the opposite side of said board, said patch being continuous thereacross except for the removal of a portion in the central region thereof; said circuit board and metallic ground plane being also continuous except for removal of a portion in the center of each to form a hole completely through the dielectric material and the metal on both sides;

a parabolic reflector;

support means extending from said parabolic reflector, along the focal axis thereof, to said circuit board to support it, with said opposite side facing toward the parabolic reflector; and feed means comprising a transmission line extending along said support means and through said hole, and coupled to said radiating element from said one side.

2. The arrangement of claim 1, wherein there is only the single radiating element, and the longer dimension thereof is approximately one-half wavelength at the frequency of operation.

3. The arrangement of claim 1, wherein said transmission line comprises a coaxial line having an outer conductor connected to said ground plane and an inner conductor passing through the circuit board from said one side to said opposite side at a location spaced away from said central region.

4. The arrangement of claim 3, wherein said feed means further includes a microstrip transformer etched on said opposite side of said circuit board continuous with said patch at an outer edge for coupling said coaxial line and matching impedance to the patch, said inner conductor being connected to the microstrip transformer near its end.

5. The arrangement of claim 4, wherein said patch is approximately square, wherein said microstrip transformer extends from the center of one side of said patch, and wherein said potion removed in the central region of the patch is relatively large, and current flow across the patch is forced to deviate around the area of removal and therefore have a longer path, which lowers the resonant frequency of radiation, there being only the single radiating element, with the dimensions thereof not greater than approximately one-half wavelength.

6. The arrangement of claim 3, wherein said support means comprises a tube and means fastening it to said circuit board, said tube serving as said outer conductor of the coaxial line.

7. The arrangement of claim 3, wherein said support means comprises a tube and means fastening it to said circuit board; and said coaxial line passes through the tube and beyond said one side of the circuit board, and returns to said one side of the circuit board at said location spaced away from said central region.

8. The arrangement of claim 3, wherein the portions removed in the central region of said patch, of said circuit board, and of said ground plane are substantially coextensive.

* * * * *